US008713891B2

(12) United States Patent
Carr et al.

(10) Patent No.: US 8,713,891 B2
(45) Date of Patent: May 6, 2014

(54) METHODS OF REINFORCING STRUCTURES AGAINST BLAST EVENTS

(75) Inventors: Heath Carr, Encinitas, CA (US); Edward Fyfe, Del Mar, CA (US)

(73) Assignee: Fyfe Co., LLC, San Diego, CA (US)

( * ) Notice: Subject to any disclaimer, the term of this patent is extended or adjusted under 35 U.S.C. 154(b) by 522 days.

(21) Appl. No.: 12/715,101

(22) Filed: Mar. 1, 2010

(65) Prior Publication Data

US 2010/0218708 A1 Sep. 2, 2010

Related U.S. Application Data

(60) Provisional application No. 61/156,461, filed on Feb. 27, 2009.

(51) Int. Cl.
*E04B 1/16* (2006.01)
*E04B 1/14* (2006.01)

(52) U.S. Cl.
USPC ..... 52/745.17; 52/167.3; 52/834; 52/831; 405/216; 405/211.1

(58) Field of Classification Search
CPC ..... E04B 1/16; E04B 1/14
USPC ..... 52/167.1, 167.3, 745.17, 834, 847, 831, 52/232, 293.3, 85–88, 236.2; 405/216, 405/212, 302.7
See application file for complete search history.

(56) References Cited

U.S. PATENT DOCUMENTS

| | | | | | |
|---|---|---|---|---|---|
| 291,208 | A | * | 1/1884 | Lesli | 52/301 |
| 312,349 | A | * | 2/1885 | Griffin | 52/834 |
| 646,503 | A | * | 4/1900 | O'Shea | 52/347 |
| 933,291 | A | * | 9/1909 | Cogswell | 52/835 |
| 992,776 | A | * | 5/1911 | Hubbard | 52/168 |
| 1,804,320 | A | * | 5/1931 | Cross | 52/249 |
| 2,742,931 | A | * | 4/1956 | Ganahl | 138/144 |
| 3,013,584 | A | * | 12/1961 | Reed et al. | 138/145 |
| 3,145,811 | A | * | 8/1964 | Strehan et al. | 52/232 |
| 3,390,951 | A | * | 7/1968 | Finger et al. | 52/516 |
| 3,574,104 | A | * | 4/1971 | Medler | 428/222 |
| 4,128,963 | A | * | 12/1978 | Dano | 264/46.6 |
| 4,439,071 | A | * | 3/1984 | Roper, Jr. | 405/216 |
| 4,468,273 | A | * | 8/1984 | Eklund et al. | 156/286 |
| 4,682,747 | A | * | 7/1987 | King et al. | 248/68.1 |
| 4,892,601 | A | * | 1/1990 | Norwood | 156/94 |

(Continued)

FOREIGN PATENT DOCUMENTS

| | | | | | |
|---|---|---|---|---|---|
| JP | 01210581 | A | * | 8/1989 | E04H 9/02 |
| JP | 02047443 | A | * | 2/1990 | E04B 2/56 |

*Primary Examiner* — Phi A
(74) *Attorney, Agent, or Firm* — Senniger Powers LLP

(57) ABSTRACT

A method of reinforcing a structural member comprises positioning a shell around the structural member, placing a force dampening material around an exterior of the shell and securing the force dampening material around the shell. In certain arrangements, the method further includes at least partially filling a space defined between the structural member and the shell with a filler material. In some embodiments, the filler material comprises a concrete, a grout, an epoxy, combinations thereof and/or the like. In one embodiment, the shell comprises a fiber reinforced polymer (e.g., CFRP, GFRP, aramid fibers, epoxy, other resins, etc.). In alternative embodiments, the methods additionally includes placing one or more layers of fiber reinforced polymer around the shell prior to placing a force dampening material around an exterior of the shell. In some embodiments, the layer of fiber reinforced polymer comprises CFRP, GFRP or any other type of fiber reinforced polymer.

25 Claims, 9 Drawing Sheets

(56) References Cited

U.S. PATENT DOCUMENTS

| | | | | |
|---|---|---|---|---|
| 5,327,694 | A * | 7/1994 | Gamel et al. | 52/834 |
| 5,481,846 | A * | 1/1996 | Macchietto | 52/831 |
| 5,899,044 | A * | 5/1999 | Jarrett | 52/834 |
| 6,219,988 | B1 * | 4/2001 | Mahfouz et al. | 52/834 |
| 6,519,909 | B1 * | 2/2003 | Fawley | 52/834 |
| 6,997,260 | B1 * | 2/2006 | Trader et al. | 166/277 |
| 7,174,680 | B2 * | 2/2007 | Smelser | 52/167.3 |
| 7,231,743 | B2 * | 6/2007 | Takeuchi et al. | 52/167.3 |
| 7,284,358 | B2 * | 10/2007 | Smelser | 52/167.3 |
| 7,305,799 | B2 * | 12/2007 | Smelser et al. | 52/167.3 |
| 7,707,788 | B2 * | 5/2010 | Bystricky et al. | 52/167.3 |
| 7,748,307 | B2 * | 7/2010 | Hallissy et al. | 89/36.04 |
| 7,762,026 | B2 * | 7/2010 | Smelser | 52/167.3 |
| 2006/0218873 | A1 * | 10/2006 | Christensen et al. | 52/737.1 |

* cited by examiner

METHODS OF REINFORCING STRUCTURES AGAINST BLAST EVENTS

CROSS REFERENCE TO RELATED APPLICATIONS

This application claims the priority benefit under 35 U.S.C. §119(e) of U.S. Provisional Patent Application No. 61/156,461, filed Feb. 27, 2009, the entirety of which is hereby incorporated by reference herein.

BACKGROUND

1. Field of the Inventions

This application relates generally to devices, systems and methods for reinforcing columns, floor slabs, beams and other portions of a structure against blasts and other events that generate potentially damaging forces and moments.

2. Description of the Related Art

Various methods of reinforcing columns and other structural components against short or long-range blast events or other occurrences responsible for generating potentially damaging forces and moments are known. For example, structures can be reinforced with steel or other metal plates or other members. However, such reinforcing techniques, which are typically relatively complex and expensive, are not always reliable. Thus, there remains a need for a more reliable, efficient and cost-effective method of reinforcing columns, floor slabs, beams and/or other components of a structure using, among other things, fiber reinforced liners or sheets, carbon, glass and/or aramid reinforcing fibers, epoxy or other resins, dampening materials and/or other materials.

SUMMARY

According to some embodiments, a method of reinforcing a structural member (e.g., a column, beam, wall, cable, etc.) against a blast and/or any other potentially damaging event or occurrence (e.g., hurricane, other storm event, high wind conditions, earthquake, other natural disaster, fires, terrorist attack, etc.) includes positioning an interior encompassing member (e.g., shell, jacket, other lining or member, etc.) around the structural member such that a first volume is defined between the interior encompassing member and the structural member. The method further includes depositing a first fill material (e.g., bendable concrete, ductile concrete, other types of concrete, grout, epoxy, sand, dirt, etc.) within the first volume to at least partially fill the first volume. In some embodiments, the method additionally comprises securing a force dampening material (e.g., polyurethane, silicone polymers, foam, other polymeric or elastomeric materials, viscoelastic materials or substances, gels, fluids, cushions, springs, air, or fluid filled members, etc.) at least partially around the interior encompassing member. In one embodiment, the force dampening material is configured to at least partially dissipate forces originating from a blast event.

In some embodiments, the interior shell, jacket or other encompassing member comprises a fiber reinforced polymer (e.g., CFRP, GFRP, resin-impregnated fiber bundles or roving, etc.), concrete, metal, alloy, paper or wood based products and/or the like. In several arrangements, the method further comprises placing at least one layer of fiber reinforced polymer around the interior encompassing member prior to securing the force dampening material around the interior encompassing member. In another embodiment, the at least one layer of fiber reinforced polymer comprises carbon fiber reinforced polymer (CFRP) or glass fiber reinforced polymer (GFRP). In other embodiments, the method further includes positioning a second shell, jacket or other encompassing member around the force dampening material, such that the force dampening material is located generally between the interior encompassing member and the second encompassing member.

According to several embodiments, the method of protecting a structural member further comprises placing at least one layer of metal (e.g., steel, iron, aluminum, etc.), alloy, polymer and/or any other material around the force dampening material. In some embodiments, such additional materials or members are provided as sheets, coatings, layer and/or the like. In another embodiment, the method further comprises reinforcing an adjacent foundation or slab with at least one layer of fiber reinforced polymer to provide progressive collapse resistance. In other embodiments, the method additionally includes placing at least one shape memory member (e.g., rod) along the inside or outside of the interior encompassing member to help encourage the structural member to return to its original orientation and position following a blast or other compromising or damaging event. In some embodiments, a shape memory rod extends, at least partially, along a length of the structural member.

According to several embodiments, the method additionally includes performing surface preparation on at least a portion of an exterior surface of the structural member prior to positioning the interior shell, jacket or other encompassing member around the structural member and/or before performing any other steps in preparation for protecting the structural member. In some embodiments, surface preparation includes cleaning, water or sand blasting, scouring, sanding, priming, coating, painting and/or the like. In some embodiments, the method additionally includes positioning a metal plate (e.g., steel or other metal angle) at an interface of the structural member and an adjacent foundation such that the metal plate is configured to couple to the structural member. In one embodiment, the metal plate is secured to a surface of the foundation and/or other adjacent surface using at least one anchor (e.g., bolt, epoxy anchor, resin, fiber reinforced anchor, etc.). In one embodiment, the surface of the foundation is generally perpendicular to said structural member. In such embodiments, the metal or other type of plate or reinforcement is configured to further protect said structural member during a blast event so that the structural member (e.g., column) remains structurally attached to the foundation. In some embodiments, the structural member comprises a column, beam, joist, floor, wall and/or the like.

According to several embodiments, a protection system for a structural member to at least partially shield said protection system from a blast or other force generating event or occurrence includes a first shell, jacket or covering configured for placement around the structural member, wherein a first void is defined between the first shell and the structural member. The system additionally includes one or more fill materials positioned within the first void to at least partially fill the first void. In some embodiments, the system additionally includes a second shell configured for placement around the first shell, wherein a second void is defined between the first and second shells, jackets or outer members. In some embodiments, the system additionally comprises at least one force dissipating material positioned within the second void, wherein the force dissipating material is configured to at least partially dissipate forces.

According to some embodiments, the fill material comprises a ductile concrete, a bendable concrete, another type of concrete, a grout, an epoxy, sand, dirt, gel, slurry, other types of setting and/or fill materials and/or the like. In some arrangements, the force dampening material comprises one or more of the following: polyurethane material, silicone polymers, foam, viscoelastic damper, other polymeric or elastomeric materials, springs, air or other fluid gaps, gels, cushions, other resilient material and/or any other material or substance configured to generally dissipate a force or moment. In some embodiments, the first shell and/or the second shell comprise a generally circular shape (e.g., rounded, elliptical, oval, etc.), a generally polygonal shape (e.g., square, rectangular, triangular, hexagonal, octagonal, other polygonal, etc.), irregular shape and/or the like. In one embodiment, the system further includes at least one layer of fiber reinforced polymer around the first shell, wherein the additional layer generally provides additional reinforcement to said system, aesthetic appeal and/or the like. In some embodiments, the fiber reinforced polymer comprises carbon fiber reinforced polymer (CFRP), glass fiber reinforced polymer (GFRP) and/or the like. In other embodiments, the system further comprises at least one layer of steel or other metal around the second shell. In some embodiments, the system comprises one or more memory shape rods and/or other materials. In yet other embodiments, the system comprises one or more fire retardant materials, sensors (e.g., temperature, pressure, impact, etc.) and/or one or more other features or devices.

According to some embodiments, a method of reinforcing a structural member comprises positioning a shell around the structural member, placing a force dampening material around an exterior of the shell and securing the force dampening material around the shell. In certain arrangements, the method further includes at least partially filling a space defined between the structural member and the shell with a filler material. In some embodiments, the filler material comprises a bendable concrete, a ductile concrete, a grout, an epoxy, combinations thereof and/or the like. In one embodiment, the shell comprises a fiber reinforced polymer (e.g., carbon fiber reinforced polymer (CFRP) glass fiber reinforced polymer (GFRP) aramid fibers, epoxy, other resins, etc.). In alternative embodiments, the method additionally includes placing one or more layers of fiber reinforced polymer around the shell prior to placing a force dampening material around an exterior of the shell. In some embodiments, the layer of fiber reinforced polymer comprises CFRP, GFRP or any other type of fiber reinforced polymer.

In other embodiments, securing the force dampening material around the shell comprises positioning a second shell around the force dampening material. In one arrangement, securing the force dampening material around the shell comprises positioning at least one layer of fiber reinforced polymer around the force dampening material. According to some arrangements, the layer of fiber reinforced polymer comprises CFRP, GFRP or any other fiber reinforced polymer. In other embodiments, the method additionally includes placing at least one layer of aramid and/or steel (e.g., 16 gauge steel, other light gauge steel, etc.) around an exterior of the force dampening material. In other arrangements, the force dampening material comprises a foam (e.g., high density foam), a viscoelastic damper, an air gap, a spring and/or other dampening materials or items. In one embodiment, the method additionally includes reinforcing an adjacent slab with at least one upper and/or lower layers of fiber reinforced polymer to provide progressive collapse resistance.

BRIEF DESCRIPTION OF THE DRAWINGS

These and other features, aspects and advantages of the present inventions are described with reference to drawings of certain preferred embodiments, which are intended to illustrate, but not to limit, the present inventions. The drawings include seventeen (17) figures. It is to be understood that the attached drawings are for the purpose of illustrating concepts of the present inventions and may not be to scale.

DETAILED DESCRIPTION OF THE PREFERRED EMBODIMENTS

Figure 1A:
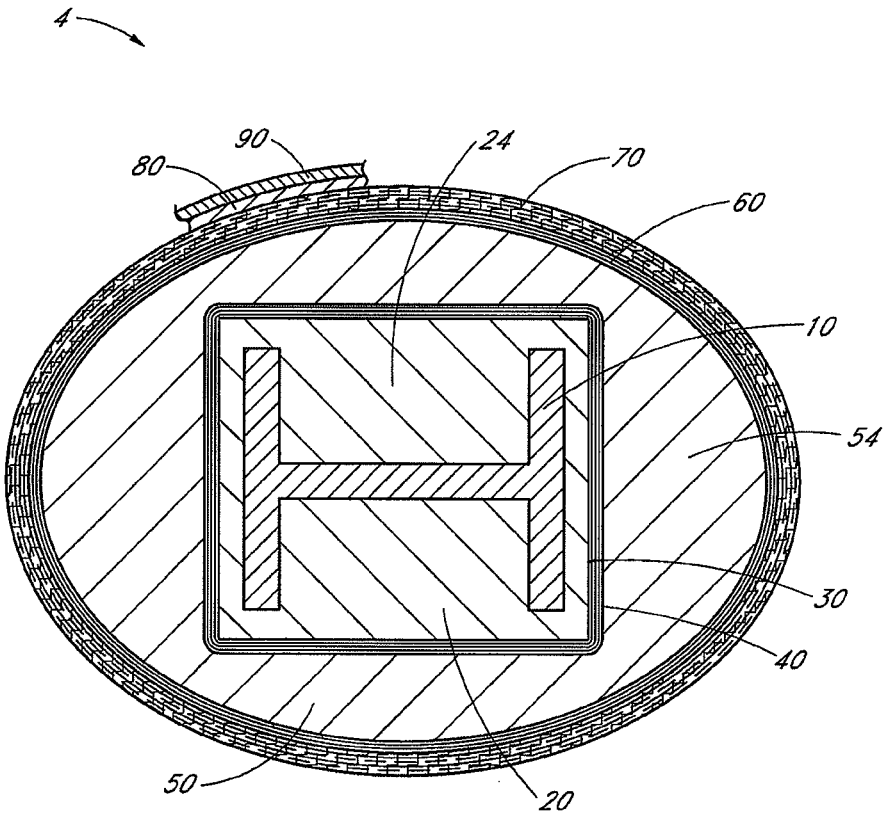
FIG. 1A illustrates a top cross-sectional view of a column or other structural member which has been reinforced to protect against a blast event according to one embodiment.
Figure 1B:
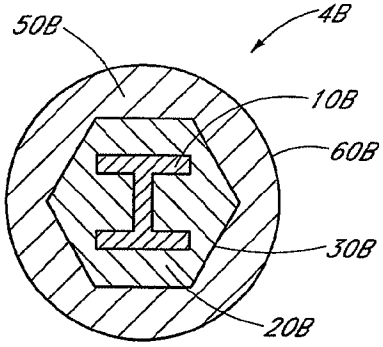
FIGS. 1B-1F illustrate various embodiments of top cross-section views of protective systems intended to surround and protect columns or other structural members.

FIG. 1A illustrates a cross-sectional view of a column (e.g., I-beam, H-pile, etc.) or other structural member 10 that has been reinforced to protect it against a blast or other event that can subject a structure to potentially damaging forces and moments. For example, the various embodiments disclosed herein can be used to protect one or more structures (e.g., columns, beams, slabs, walls, girders, joists, cables, etc.) and/or other items against close range and/or long range blasts and/or any other potentially threatening occurrence or event. Thus, although the various embodiments disclosed herein may be discussed with specific reference to blast events, the features, advantages and other characteristics related to such embodiments can be used to protect structures against other occurrences where structural reinforcement is desired or needed, such as, for example, seismic events, hurricanes, tsunamis, tornadoes, other events having excessive wind conditions, impacting events (e.g., direct or indirect, intentional or accidental, etc.), terrorists attacks and/or the like.

As illustrated in FIG. 1A and in any of the embodiments illustrated herein, reinforcement systems can be used protect structural members of different types, sizes, shapes, materials of fabrication or construction, intended use and/or the like.

For example, in some arrangements, the structural members include steel or concrete beams, piles or other members that have a standard (e.g., I-beams, channels, angles, cables, etc.) or non-standard (e.g., customized) shapes and/or sizes.

With continued reference to FIG. 1A, an inner or first shell 30 can be placed around the column 10. The shell 30 can comprise fiber-reinforced polymer and/or any other materials. In some embodiments, the shell 30 comprises carbon fiber reinforced polymer (CFRP), glass fiber reinforced polymer (GFRP), aramid reinforcing fibers, other reinforcing polymers or materials, epoxies, other resins, grouts, cementitious materials, steel or other metals, wood or paper-based materials and/or any other material. In some embodiments, the shell 30 comprises a pre-fabricated jacket, such as, for example, a jacket currently sold under the name Tyfo® PR and provided by Fyfe Co. LLC. In other arrangements, however, the shell 30 can be formed into a desired shape after it has been delivered to the jobsite, thereby permitting its shape to be customized according to the size, shape and/or other characteristics of the column or other structural member 10 around which it will be placed.

The shell, jacket or other encompassing member 30 that is configured to generally surround a column or other structural member being protected can comprise any shape, such as, for example, square, other rectangular, triangular, octagonal, other polygonal, circular, oval, irregular and/or the like.

In some embodiments, the shell or jacket 30 includes two or more portions that are configured to mate or otherwise attach to each other. For instance, in one embodiment, the shell includes two hemispherical portions that can be coupled to each other in order to surround a structural member using adhesives, fasteners, welds, hot melt connections and/or any other attachment method or device. In another embodiment, the shell, jacket or other encompassing member 30 includes a single portion with a longitudinal slit or other opening that allows a user to place it around a column or other member. To facilitate placement of the shell or jacket around a target structural member, the shell or jacket can comprise one or more flexible or other resilient materials that permit the slit or other opening to be selectively widened during installation. In yet other embodiments, the shell or jacket is rigid or semi-rigid, and generally not resilient. In another embodiment, the shell or jacket comprises a continuous sheet of plastic and/or other flexible material that can be bent into a desired shape such that it generally surrounds a structural member when properly installed.

According to several embodiments, once the shell or jacket 30 has been properly positioned around a column or other structural member 10, one or more materials, items and/or the like can be positioned within an interior space 24 defined by the shell 30. In some arrangements, the interior space 24 is partially or completely filled with one or more materials 20, such as, for example, bendable concrete, ductile concrete, any other type of concrete, grout and/or epoxy, other setting or flowable materials, combinations thereof and/or the like.

Thus, as depicted in FIG. 1A, such concrete, grout or other filler material 20 can completely or partially fill the cavity of the shell 30 around the column 10. Such materials, together with any other items or materials placed around them (e.g., shells or jackets 30, 60, reinforcement layers, other fill material, other resilient or force absorbing items or materials, etc.) can help shield or otherwise guard the column 10 or other structural member against the damaging effects of a blast, impact or other event. In some embodiments, such fill materials or other items are sacrificial in nature, and thus, are not designed to remain intact, at least in their original form, following a blast or other threatening event. For instance, such materials can be configured to protect the structural integrity of the column 10 or other member at their own expense (e.g., by absorbing or otherwise dissipating the forces generated by a blast or other event before they reach the column or other member). In yet other embodiments, the fill materials and/or other items placed around the column or other structural member are designed to maintain their own structural integrity for certain types of blasts and other threatening events, as required or desired.

According to some embodiments, one or more layers 40 of fiber reinforced polymer (e.g., CFRP, GFRP, etc.) and/or other reinforcement layers are placed around the outside of the inner jacket or shell 30. These layers 40 can be provided as sheets, strips, splayed or spread roving or bundles and/or in any other form, as desired or required. Regardless of their exact composition, configuration, orientation and/or other details, such reinforcement 40 can advantageously provide a desired or required level of strengthening to the shell 30, the column 10 (or other member being protected) and/or the entire reinforcement system. In some embodiments, one or more reinforcement layers 40 or coatings are positioned along the outside of the shell 30 or other protective enclosure using resin-impregnated and splayed fiber roving or bundle. Additional disclosure regarding such embodiments is disclosed in U.S. patent application Ser. No. 12/709,388, filed Feb. 19, 2010, the entirety to which is hereby incorporated by reference herein.

With continued reference to the embodiment illustrated in FIG. 1A, another shell 60, jacket or other encompassing member can be positioned around the inner shell or jacket 30. In the depicted arrangement, this secondary, outer shell 60 includes a generally oval shape. However, as discussed with reference to the interior shell 30, the secondary shell 60 can comprise any other shape, such as, for example, square, other rectangular, triangular, octagonal, other polygonal, circular, irregular and/or other like, as desired or required. The inclusion of a secondary (or additional) shells or jackets can further enhance the blast protection characteristics of a system. Thus, a blast protection reinforcement system can be specifically customized according to target and/or desired design parameters.

As discussed herein with reference to the interior shell, the second, outer shell or jacket 60 can comprise one or more materials, such as, for example, carbon fiber reinforced polymer (CFRP), glass fiber reinforced polymer (GFRP), aramid reinforcing fibers, other reinforcing polymers or materials, epoxies, other resins, grouts, cementitious materials, steel or other metals, wood or paper-based materials and/or any other material. In some embodiments, the shell 60 comprises a pre-fabricated jacket, such as, for example, the Tyfo® PR and/or the like. In other arrangements, however, the shell 60 can be formed into a desired shape after it has been delivered to the jobsite, thereby permitting its shape to be customized according to the size, shape and/or other characteristics of the column (or other structural member), interior shell or jacket and/or any other items around which it will be placed.

In some embodiments, the space 54 between the interior of the secondary (or exterior) shell or jacket 60 and the interior shell or jacket 30 is filled with one or more materials or items. The materials and/or items 50 placed within the space 54 along an interior of the second shell or jacket 60 can be configured to generally absorb and/or dampen the forces and moments resulting from a blast event (e.g., short-range, long-range, etc.), a seismic event, high wind conditions, an impacting event, a terrorist attack and/or any other natural or man-made occurrence. For example, such impact absorbing materials or components can include, without limitation, high density foam, other types of foams or other polymeric materials, bendable concrete, other types of concrete, other materials with favorable dampening properties, viscoelastic dampers, other resilient materials or items, an air gap, springs and/or the like. Such materials and/or other items can partially or completely occupy the space 54 between the interior and secondary shells or jackets 30, 60, as desired or required for a particular application or use. In any of the embodiments illustrated and/or described herein, one or more fire retardant materials can be included within the interior of a shell or other encompassing member 30, 60, either in lieu of or in addition to other fill materials and/or impact absorbing materials or items. Thus, the protection system can help protect a column 10 or other structural member against fire, heat and/or the like.

As discussed with reference to the interior shell or jacket 30 above, one or more other layers can be selectively placed along the outside of the secondary shell 60 to provide certain structural and/or aesthetic characteristics, as desired or required for a particular application or use. For example, as illustrated in FIG. 1A, one or more layers 70 of the fiber reinforced polymer (e.g., resin impregnated fiber sheets, roving or bundles, etc.) can be affixed along the outside of the shell 60. As discussed, such layers 70 can include CFRP, GFRP and/or the like. These layers 70 can be provided as sheets, strips, splayed roving or bundles and/or in any other form, as desired or required. According to some embodiments, such reinforcement layers 70 and/or other exterior layers, coating and/or the like generally serve a protective and/or sacrificial role for a particular type of blast event or other occurrence.

As illustrated in FIG. 1A and discussed above, the column 10 can be reinforced with one or more additional exterior layers 80, 90, coatings and/or any other material or item. Such additional layers, coatings and/or the like can provide additional strength, toughness, resiliency, absorption and/or other structural and/or aesthetic characteristics for a reinforcement system. For example, in one embodiment, a layer of aramid fibers 80 can be positioned along the outside of the fiber reinforced polymer layers 70. In addition, one or more layers of metals (e.g., 16 gauge steel, other light gauge steel, etc.), other metals or alloys, polymeric materials, wood or paper-based materials and/or the like can also be placed around the column 10. In embodiments that incorporate steel, other metals or alloys and/or other materials along an exterior of a blast protection reinforcement system, the gauge or thickness of such layers or members can vary, as desired or required. In certain arrangements, such additional layers 80, 90 provide toughness and strength to the reinforced design.

In other embodiments, more or fewer layers or components can be used to protect a column or other structural component against a blast event or other potentially damaging occurrence (e.g., seismic event, tornado, hurricane, other high wind situation, etc.). Alternatively, the various layers or components can be arranged or oriented differently than shown in FIG. 1A and/or in any of the other embodiments illustrated herein. The layers, coating and/or any other materials or items that are incorporated into a particular blast protection reinforcement system can be secured, applied and/or otherwise positioned in a desired orientation using one or more attachment methods or devices, such as, for example, adhesives, bolts or other fasteners, welds, rivets, straps and/or the like.

In some embodiments, one or more other features or devices can be included to a reinforcing system. For example, a reinforcement system can comprise one or more sensors (e.g., pressure, force or other impact sensors, vibration sensors, strain sensors, temperature sensors, etc.) within one or more of the items or layers that surround a column or other structural member being protected. These sensors can help determine whether and/or to what extent a structural member has been undermined by a blast event or other potentially damaging occurrence or event. In other embodiments, the interior shell or jacket 30, the secondary (exterior) shell or jacket and/or any other portion of the system can include a port, nozzle, inlet or other opening through which fill material can be injected. For example, one or both of the shells or jackets 30, 60 provided in the protection system of FIG. 1A can include a nozzle (not shown) for delivering concrete, foam, grout, epoxy, air or other fluids and/or the like to the corresponding interior space 24, 54.

Figure 1C:
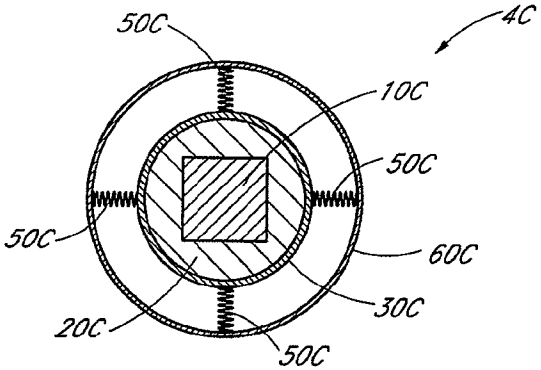

Alternative embodiments of a reinforcement/protection system for a column and/or any other structural member 4B-4F are illustrated in FIGS. 1B-1F. As shown, a protection system can include more or fewer members and/or differently configured members, portions, layers, coatings, features and/or the like, as desired or required by a particular application or use. For example, in FIG. 1B, the protective system 4B includes a hexagonally shaped interior shell or jacket 30B and a circular secondary shell or jacket 60B. In FIG. 1C, the column 10C is surrounded by generally circular interior and secondary shell or jackets 30C, 60C. As shown, one or more springs 50C and/or other resilient members can be positioned between the concentrically aligned shells 30C, 60C to help absorb or otherwise dissipate blasts or other impacting forces to which the column 10C may be subjected.

Figure 1D:
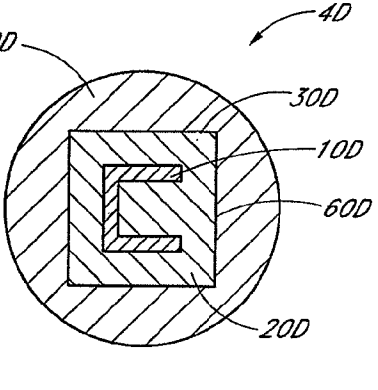

With reference to the embodiment illustrated in FIG. 1D, a protective system 4D for a structural member 10D (e.g., a channel, I-beam, etc.) can include an interior shell, jacket or other encompassing member 30D with a square, rectangular or other non-rounded shape. As shown, the protective system 4D can additionally include a circular outer or secondary shell, jacket or other encompassing member 60D situated around the interior shell 30D.

Figure 1E:
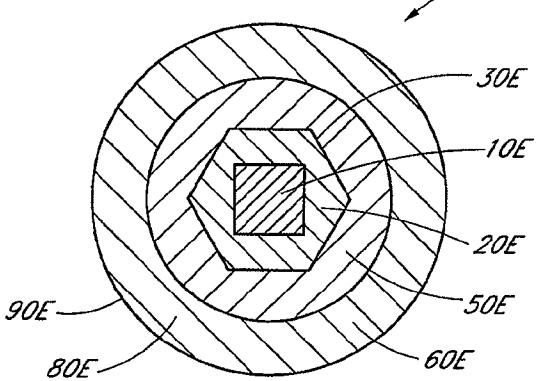

As depicted in FIG. 1E and discussed in greater detail herein, a protective system 4E can include more than two shells, jackets or other encompassing members, as desired or required for a particular design, application or use. For instance, in FIG. 1E, the system 4E comprises an interior shell or jacket 30E that is hexagonal in shape. Further, the interior shell 30E is surrounded by generally-concentric secondary and tertiary circular encompassing members 60E, 90E.

Figure 1F:
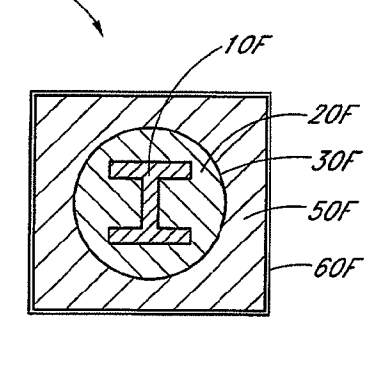

FIG. 1F illustrates one embodiment of a protective system 4F that includes a generally circular interior encompassing member 30F positioned around a structural member (e.g., an I-beam) and a generally square or rectangular secondary (or exterior) encompassing member 60F positioned around the interior encompassing member 30F. As noted above, in any of the embodiments illustrated and/or discussed herein, or equivalents thereof, one or more materials or items (e.g., bendable or ductile concrete, other type of concrete, grout, viscoelastic materials, gels, fluids, other fill materials, springs, air pockets and/or the like) can be placed within one or more of the encompassing members 30, 60, 90 (e.g., between adjacent encompassing members). Further, a protective system can include one or more other layers, coatings, members and/or the like (e.g., resin-impregnated fiber layers, splayed roving or bungle, metal plates or sheets, straps, paint, etc.), as desired or required.

Figure 2:
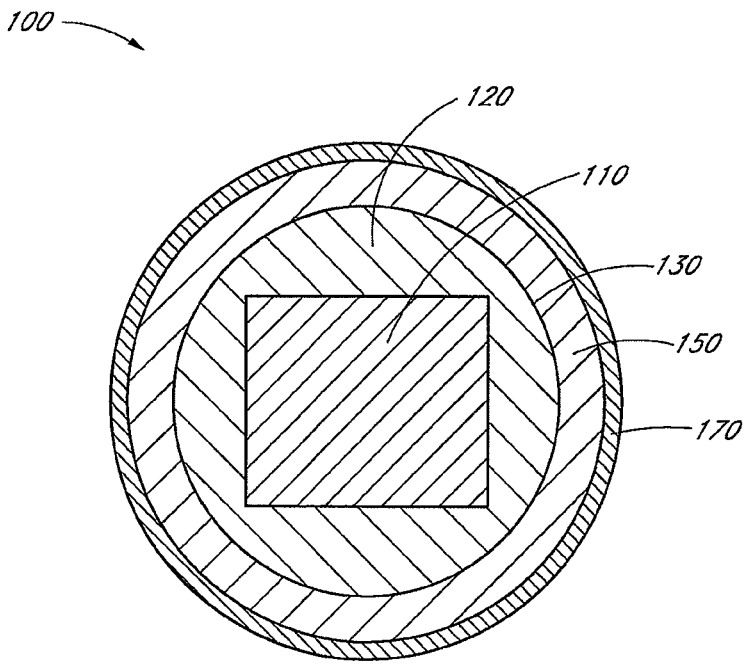
FIG. 2 illustrates a top cross-sectional view of a column or other structural member which has been reinforced to protect against a blast event according to another embodiment.

By way of example, another reinforcement/protection system 100 for a column 110 or other structural member is illustrated in FIG. 2. In FIG. 2, as with any other embodiments depicted herein, the system 100 can be used to protect columns and/or any other type of structural member (e.g., slabs, walls, girders, joists, cables, beams, etc.) of various sizes, shapes, configurations, structural importance and/or the like.

As shown in FIG. 2, the structural member 110 (e.g., column) can include a generally circular or oval shell, jacket or other encompassing member 130 around its exterior surface. However, in other arrangements, the shape of the shell or jacket 130 can be different than illustrated, such as, for example, square, rectangular, octagonal, other polygonal, etc. In some embodiments, the shell 130 comprises a carbon fiber reinforced polymer (CFRP), glass fiber reinforced polymer (GFRP), aramid reinforcing fibers, epoxies or other resins, metal, alloys, paper or wood based materials, and/or any other material.

As discussed herein with reference to FIG. 1A, once the shell 130 has been properly positioned around the column 110, the interior space of the shell 130 can be filled with a bendable concrete 120, ductile concrete, any other type of concrete, grout and/or epoxy, gels, resilient materials or items, foams, springs, air gaps, other fluids, combinations thereof and/or the like. Thus, such concrete 120, grout and/or other fill materials can be used to partially or completely fill the cavity or space 124 between the shell or jacket 130 and the structural member 110 being protected. In several embodiments, the column or other structural member 110 undergoes one or more types of surface treatment before the shell or jacket 130 and/or fill materials or items 120 are deposited therearound. For example, the column can be cleaned, sand or water blasted to remove outer linings or layers, painted or otherwise coated and/or the like, as desired or required by a particular application or use. In addition, as discussed herein with reference to the system depicted in FIG. 1A, one or more layers, coatings and/or other materials or substances can be placed around at least a portion of the shell or jacket 130 to further enhance the strength, impact or blast resistance, aesthetics and/or other characteristics of the protective system 100.

With continued reference to the embodiment depicted in FIG. 2, one or more materials 150 that are configured to generally absorb and/or dampen the forces, moments and other potentially damaging impact resulting from a blast event (e.g., short-range, long-range, etc.), a terrorist attack, a seismic event, high wind conditions and/or any other natural or manmade occurrence can be positioned around the exterior of the shell 130. For example, such impact absorbing materials or components can include, without limitation, high density foam, polyurethane, silicone polymers, other polymeric materials, rubber or other elastomeric materials, gels, viscoelastic dampers, air gap, springs, other resilient materials and/or the like. Such impact absorbing or dissipating materials or components can help reduce or otherwise mitigate the impact that blast, impact or other forces have on the structural member 110 (e.g., column, beam, wall, etc.). As a result, such resilient or other impact absorbing materials and components can help protect the structural member 110.

With continued reference to FIG. 2, one or more exterior layers 170 or components can be positioned generally around the absorbing or dampening materials. In several embodiments, such layers include CFRP, GFRP, other fiber reinforced resins or polymers and/or the like. These layers 170 can be provided as sheets, strips, splayed roving or bundles, shells or jackets, and/or in any other form, as desired or required. According to some reinforcing designs, such reinforced layers 170 and/or other exterior layers generally serve a sacrificial role for a particular type of blast event or other occurrence. However, in other embodiments, one or more of such outer layers 170 can be designed to generally withstand a blast and/or another type of potentially damaging event, condition or occurrence.

In any of the embodiments illustrated and/or described herein, including, but not limited to, those depicted in FIGS. 1A-1F, 2 and 3A-3F, one or more fire retardant materials can be included within the interior of a shell or other encompassing member 30, 60, either in lieu of or in addition to other fill materials and/or impact absorbing materials or items. Thus, the protection system can help protect a column 10 or other structural member against fire, heat and/or the like.

As shown in FIGS. 1A, 1B, 1C, 1D, 1E and 2, the exterior shape of the protective system placed around a column or other structural component can include, at least in part, a circular, oval or other rounded shape. In some embodiments, such a rounded shape can help dissipate, deflect and/or spread the forces resulting from a blast or other potentially damaging event or occurrence along a greater surface area, thereby reducing the likelihood of causing localized damage to a smaller surface area of the outer reinforcement and the column 10, 10B-10F, 110 which such reinforcement surrounds. However, as illustrated in FIG. 1F, the outer layer of a protective system 4F can include a non-rounded shape (e.g., generally planar surface formed by a square or rectangular outer shell or jacket. A protective system can include any other rounded or non-rounded shape.

Another embodiment of a system for protecting a column 210 or other structural member against a blast or other potentially damaging event or occurrence is illustrated in FIGS. 3A-3F. As shown in FIGS. 3A-3D, a shell, jacket or other encompassing member 230 can be positioned around the column 210 or other member being protected. As discussed with reference to other embodiments disclosed herein, including, without limitation the protective systems illustrated in FIGS. 1A-1F and 2, the shell 230 can include a carbon fiber reinforced polymer (CFRP), glass fiber reinforced polymer (GFRP), aramid reinforcing fibers, other types of fiber-reinforced resins or polymers, epoxies or other resins, metals or alloys, paper or wood based materials and/or any other material. Although not illustrated in FIGS. 3C and 3D, once a shell 230 or other encompassing member has been properly positioned around the column 210, the interior space of the shell 230 can be filled (e.g., partially or completely) with a bendable concrete, ductile concrete, any other type of concrete, grout and/or epoxy, combinations thereof and/or any other material. As discussed in greater detail herein, such materials can advantageously shield and protect the column 210 or other structural member. In some embodiments, such fill materials and/or the encompassing member 230 are sacrificial in nature, in that they are designed to be partially or completely irreparably damaged during a blast or other occurrence or event. However, in other embodiments, the protective system is configured so that such fill materials and/or the encompassing member 230 are designed to withstand certain types of blasts or other damaging events or occurrences.

Figure 3A:
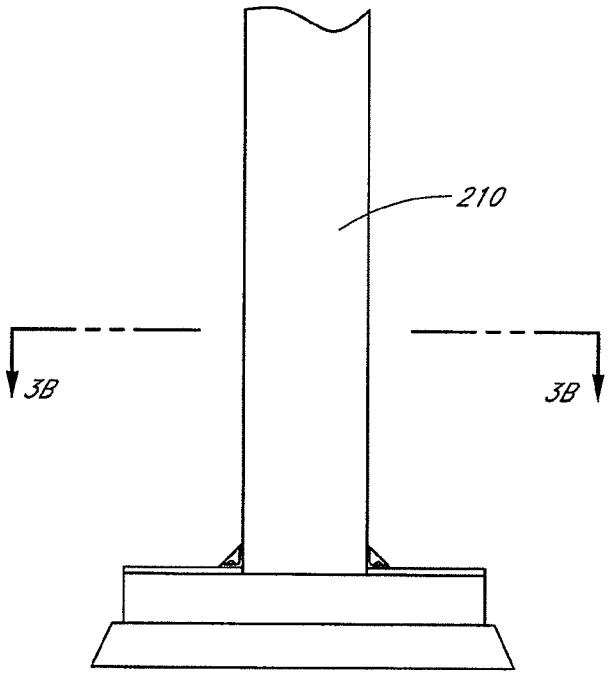
FIGS. 3A and 3B illustrate an elevation view and a cross-sectional view, respectively, of a column or other structural member according to one embodiment.
Figure 3B:
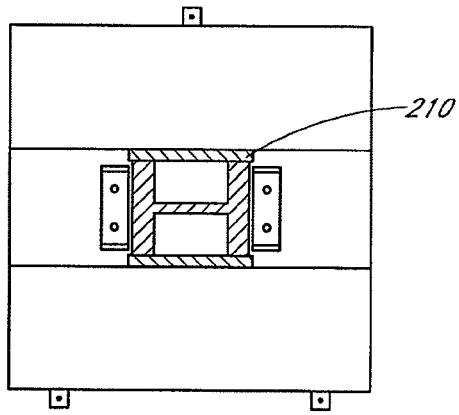
Figure 3C:
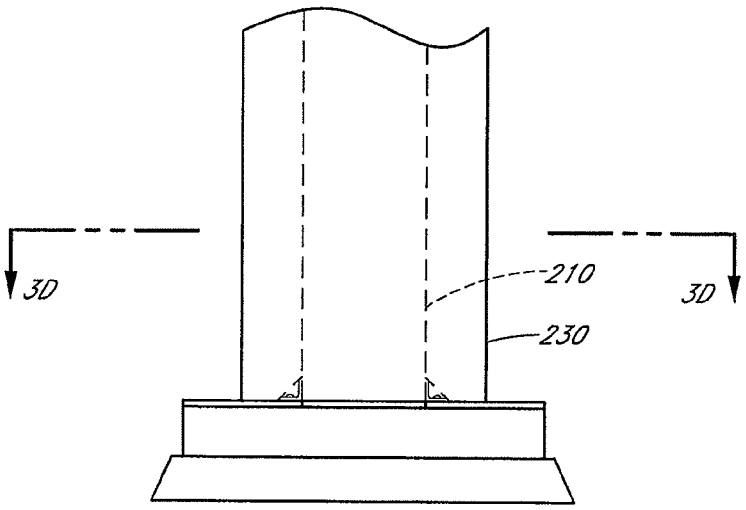
FIGS. 3C and 3D illustrate an elevation view and a cross-sectional view, respectively, of the column of FIGS. 3A and 3B following a first reinforcing or protection step to protect the column from a blasting event, according to one embodiment.
Figure 3D:
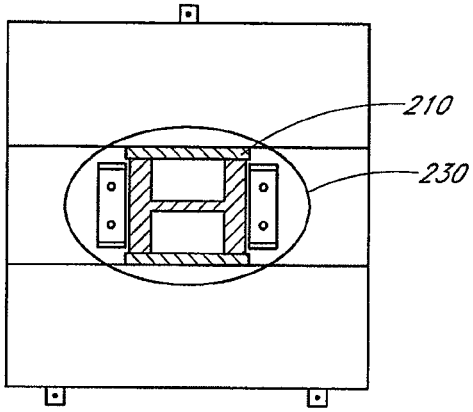
Figure 3E:
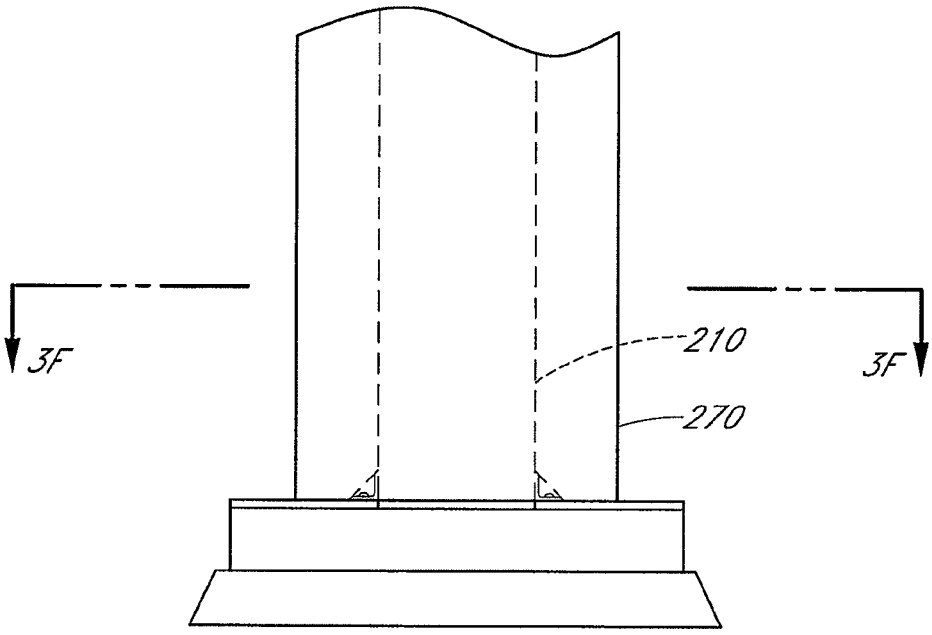
FIGS. 3E and 3F illustrate an elevation view and a cross-sectional view, respectively, of the column of FIGS. 3A-3D following a second reinforcing or protection step to protect said column from a blasting event, according to one embodiment.
Figure 3F:
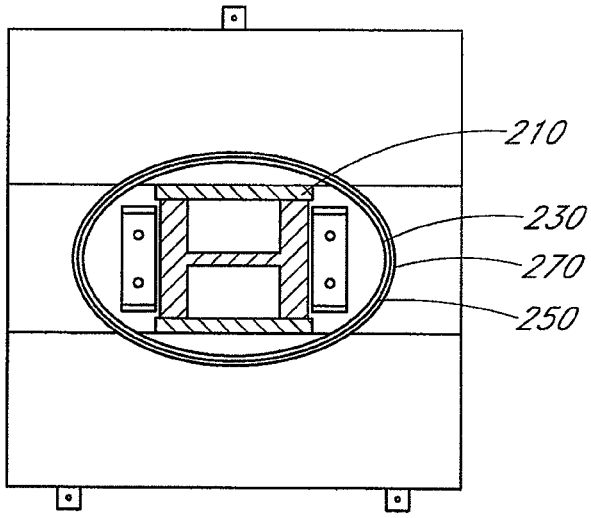

With reference to FIGS. 3E and 3F, one or more materials 250 and/or items that are configured to shield the column 210 and/or generally absorb or dampen the forces, moments and other impact resulting from a blast event (e.g., short-range, long-range, etc.), a seismic event, high wind conditions and/or any other natural or manmade occurrence can be positioned around the exterior of the shell 230, jacket or other encompassing member. For example, such impact absorbing materials or components can include, without limitation, high density foam, polyurethane, silicone polymers or other polymeric or elastomeric materials, other types of foam or resilient materials, viscoelastic dampers, air gaps, springs and/or the like.

Further, one or more exterior layers 270 or components can be positioned generally around the absorbing or dampening materials. In certain embodiments, such layers include CFRP, GFRP, other fiber-reinforced polymers, layers of steel or other metals or alloys, wood or paper based materials, coatings and/or the like. These layers and/or other components 270 can be provided as sheets, strips, splayed roving or bundles and/or in any other form, as desired or required. According to some reinforcing designs, such fiber reinforced layers 270 and/or other exterior layers generally serve a sacrificial role for a particular type of blast event or other occurrence.

In any of the embodiments discussed and/or illustrated herein, or equivalents thereof, the reinforcing methods can be used on any type structural member, including, but not limited to, members comprising steel, other metals or alloys, concrete (e.g., reinforced or unreinforced), wood, masonry, steel encased member, field-fabricated or prefabricated members and/or the like. As discussed and illustrated with reference to other embodiments herein, the various shells, jacket or other encompassing members used in a blast protection system can comprise any shape (e.g., circular, oval, rectangular, hexagonal, octagonal, irregular, etc.), size and/or configuration, as desired or required by a particular design, application or use.

Further, according to certain arrangements, the shells 30, 60, 130, 230 are countersunk to protect the structural connections associated with the column or other structural member. In other embodiments, fiber reinforced anchors, such as those disclosed in U.S. Pat. No. 7,207,149, can be connected to or otherwise used in conjunction with the various blast reinforcement layers and designs discussed herein. The various anchors and other systems disclosed in U.S. Pat. No. 7,207,149 are hereby incorporated by reference herein. In addition, the blast protection systems disclosed herein, or equivalents thereof, can be used in conjunction with any other type of anchor and/or other reinforcement system.

Figure 4A:
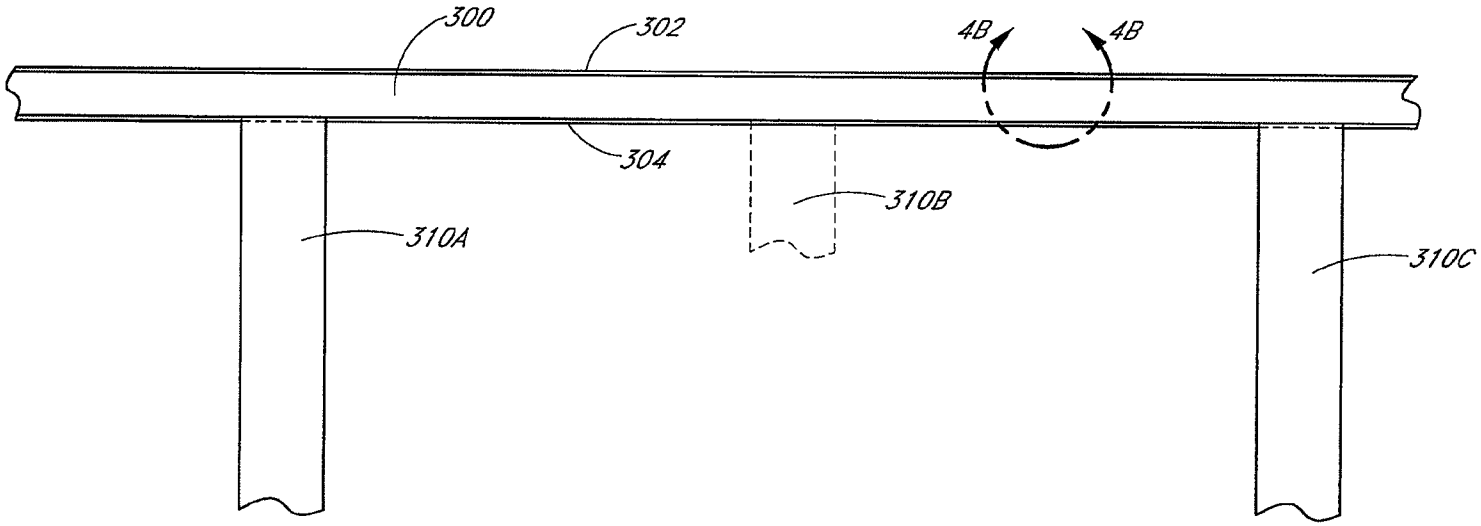
FIG. 4A illustrates cross-sectional view of a slab and a plurality of columns connected thereto that have been reinforced to protect against a blast event according to one progressive collapse resistance embodiment.
Figure 4B:
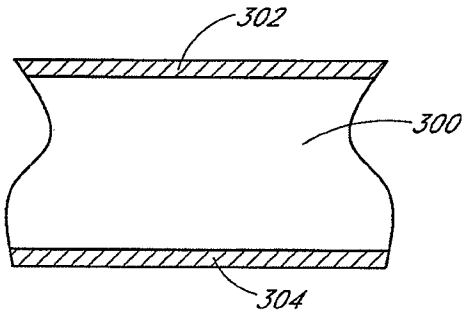
FIG. 4B illustrates a detailed cross-sectional view of the slab of FIG. 4A.

Additional structural integrity to a structure can be provided by utilizing a progressive collapse resistance design, either in conjunction with or in lieu of the reinforced columns disclosed herein. For example, as illustrated in the embodiment of FIGS. 4A and 4B, a concrete or other type of slab 300 can be coated with upper and/or lower layers 302, 304 of fiber reinforced resin, as required to achieve the desired structural characteristics. In some embodiments, such upper and/or lower layers 302, 304 include CFRP, GFRP, aramid reinforcing fibers, epoxies or other resins and/or any other material. Therefore, as illustrated in FIG. 4A, one or more columns 310B (shown in phantom) may fail as a result of a blast or other potentially damaging event. Accordingly, the layers 302, 304 along one or both sides of the slab 300 can help accommodate the moments (e.g., positive or negative moments) resulting from the failed column 310B. For instance, in the depicted arrangement, once column 310B fails, the lower layer 304 of CFRP or other material can help resist the positive moment generated within the slab 300, and the upper layer 302 of CFRP or other material can help resist the negative moment generated within the slab 300. In some embodiments, such a progressive collapse resistance design is used together with the reinforced columns, as disclosed herein with reference to FIGS. 1A-1F, 2 and 3A-3C, to provide enhanced structural reinforcement to a structure against a blast event, earthquake, high wind condition and/or the like. In some arrangements, the goal of such a comprehensive design is to prevent catastrophic failure to a structure (e.g., to allow for safe egress from that structure). Thus, in some embodiments, the slabs, columns and/or other structural components are designed to irreversibly deflect but not completely fail.

As discussed with reference to the various embodiments herein, columns and/or other structural members included in a particular structure or other engineered system or environment can be configured to withstand the impact, forces, moments, heat and/or other elements that are associated with a particular blasts and/or other damaging occurrence or event (e.g., earthquakes, high wind conditions, etc.). However, in certain embodiments, such columns or other structural members can be compromised in non-direct or other ways. In other words, although a column or other structural member can be generally shielded and protected by the direct impacting forces generated by a blast, such a column or other structural member can fail because of its connection to an adjacent slab, member or other adjacent surface.

Figure 5:
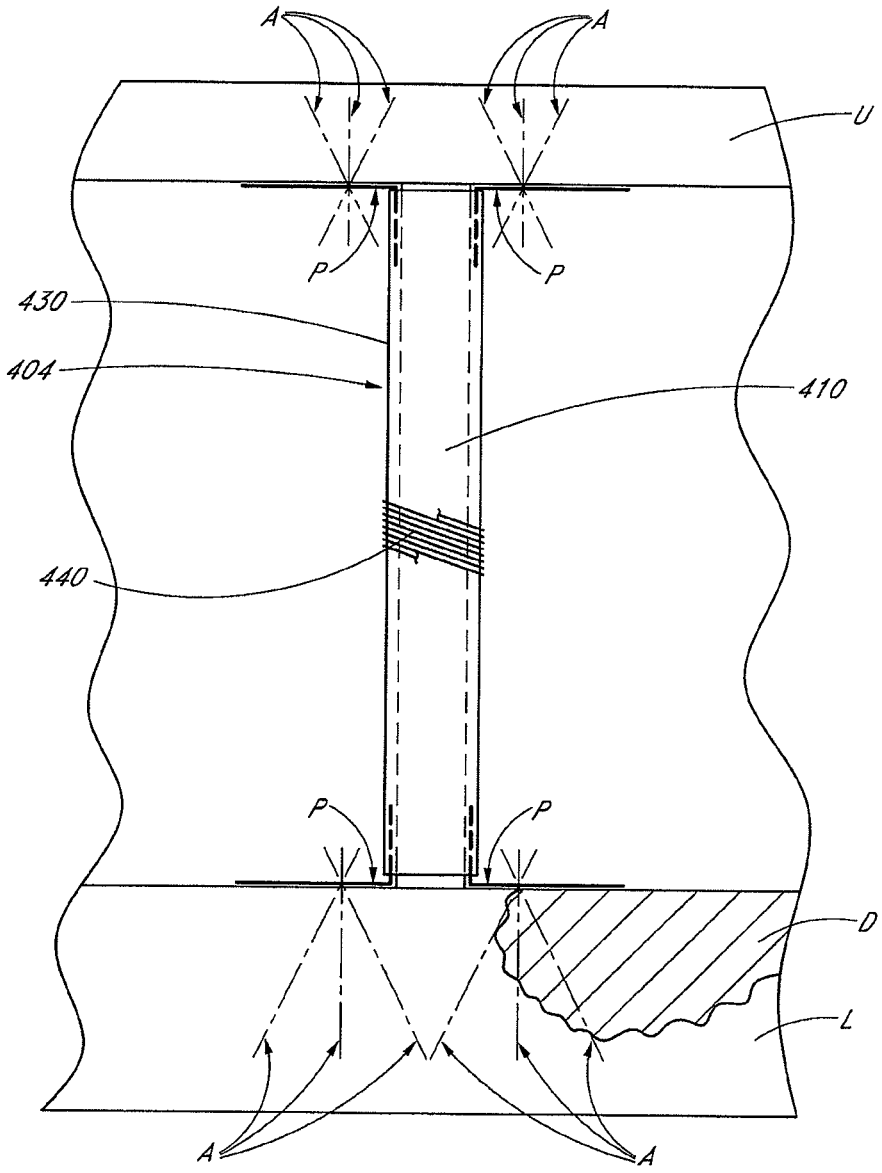
FIG. 5 illustrates a cross-sectional view of a column or other structural member located between adjacent foundation or slab members according to one embodiment.

By way of example, FIG. 5 illustrates one embodiment of a column 410 that generally extends between a lower surface or member L (e.g., concrete slab) and an upper surface or member U. As shown, the column 410 can be surrounded by a protective system 404, such as any of the systems disclosed herein (e.g., those illustrated in FIGS. 1A-1F, 2, 3A-3F, 4A, 4B, etc.) or equivalents thereof. For example, the column or other structural member 410 can comprise one or more shells, jackets or other encompassing members 430, impact absorbing materials or items (e.g., polyurethane, silicone polymers, foam, springs, air or other fluid pockets, etc.), fill materials (e.g., concrete, grout, other sacrificial or non-sacrificial materials, etc.), layers 440, sheets or other forms of fiber-reinforced resins (e.g., resin-impregnated sheets, resin-impregnated fiber roving or bundle, etc.), fire-retardant materials, other types of layers, coatings, members, etc. As discussed in greater detail herein, the various materials, items and/or other features that help comprise a protective system 404 can be configured to prevent damage to any portion of the column 410 or other structural member as its extends between adjacent lower and upper surfaces L, U.

However, as illustrated in the embodiment of FIG. 5, the structural integrity of the column 410, and thus, the integrity of the structure or system in which the column 410 is incorporated, can be compromised if a blasting event or occurrence imparts damage to the upper or lower slabs U, L, foundation and/or other adjacent or adjoining portion of the structure. For example, a blast or other event can remove or otherwise damage a portion of the lower slab L or foundation (illustrated in FIG. 5 as area D). Thus, although the column 410 itself may be directly protected by the impact and other potentially-damaging forces generated by a blast or other event or occurrence, damage to a slab, foundation or other adjacent surface to which the column 410 attaches can cause the column 410 to collapse or otherwise lose structural strength or integrity.

Accordingly, in several embodiments, the connection between the column 410 and adjacent portions of the slab L, U, foundation (or other surfaces or components to which the column 410 is attached) can be reinforced. In FIG. 5, steel or other metal plate P is provided at the interface of the column 410 and the adjacent slabs L, U. For example, such plate P can comprise an angle (e.g., 90 degree), L-shaped member and/or the like that is positioned, either intermittently or continuously, at the upper and lower ends of the column 410. In some embodiments, such an angle member is configured to extend continuously around the entire column 410. In other embodiments, two or more separate angles or other plates P can be situated around a column 410, either continuously or intermittently. The angle or other plate P can be coupled to the column 410 using one or more connection methods or devices, such as, for example, anchors, bolts, other fasteners, welds, straps, fiber-reinforced layer or wrapping and/or the like. Likewise, the plate P can be secured to adjacent portions of the slab and/or any other adjacent surface using anchors A, anchor bolts, other fasteners and/or any other connection method or device. For example, in some embodiments, the angle, plate P or other reinforcement member located at the interface of a column 410 or other structural member and an adjacent portion of a structure is secured to an adjacent slab (e.g., concrete slab) using one or more fiber anchors. Details regarding several embodiments of fiber anchors than can be used in such an application are disclosed in U.S. Pat. No. 7,207,149, which is hereby incorporated by reference herein. In other embodiments, one or more other types of anchors or securement systems can be used to further reinforce the connection between a column 410 (or other structural member) and adjacent surfaces or portions of a structure or other engineered system.

Accordingly, as illustrated in FIG. 5, even if a blast or other event causes damage D to the slab L or other adjacent surface, the plate P, the anchors A and/or other components of a reinforcement system can help maintain the column 410 adequately in place so that it continues to provide vertical support and/or resistance to moments. Such designs can help ensure that a structure remains intact and does not collapse during a blast or any other type of potentially damaging event or occurrence.

In any of the embodiments disclosed herein, or equivalents thereof, a reinforcement system can comprise one or more shape memory materials or members. Such shape memory materials can help provide a desired level of flexibility, bendability and/or other movement to a column of other structural member during a blast or other potentially damaging event or occurrence. The use of shape memory components and/or materials can help ensure that integrity of the structural member is maintained since such components or materials are configured to return to an equilibrium position after the impact, forces, moments and/or other results of a blast or other event have been dissipated.

Figure 6:
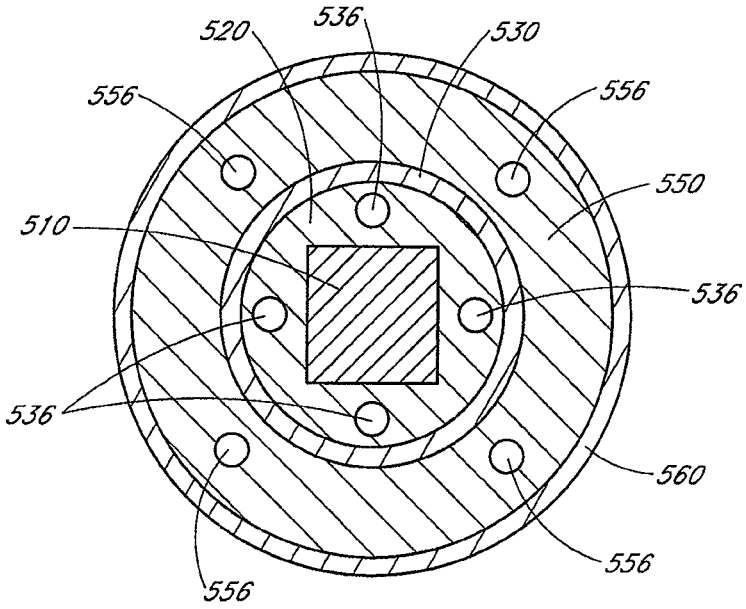
FIG. 6 illustrates a cross-sectional view of a protection system for a column or other structural member that comprises shape memory materials according to one embodiment.

One embodiment of a protection system 500 for a column 510 or other member incorporating such shape memory members or materials is illustrated in the cross-sectional view of FIG. 6. As shown, the shape memory members 526, 556 can be positioned along any layer and/or portion of the system, such as, for example, within the interior shell or jacket 530, between the interior shell 530 and the secondary jacket 560 and/or like. In some embodiments, such shape memory members comprise rods, stands or other elongated members that extend along at least a portion of the column 510 or other member being protected. Shape memory members or materials can comprise one or more metals, alloys, polymeric materials, elastomeric materials and/or the like. Further, the shape (e.g., cross-sectional shape), size, location, spacing and/or any other characteristics of the shape memory materials or members can vary, as desired or required for a particular design, application or use.

The systems, apparatuses, devices and/or other articles disclosed herein may be formed through any suitable means. The various methods and techniques described above provide a number of ways to carry out the inventions. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the inventions have been disclosed in the context of certain embodiments and examples, it will be understood by those skilled in the art that the inventions extend beyond the specifically disclosed embodiments to other alternative embodiments and/or uses and obvious modifications and equivalents thereof. Accordingly, it is not intended that the inventions be limited, except as by the appended claims.

What is claimed is:

1. A method of reinforcing a pre-positioned structural member against a blast event, the method comprising:

positioning an interior encompassing member around the pre-positioned structural member, wherein a first volume is defined between said interior encompassing member and said pre-positioned structural member;

depositing a first fill material within the first volume to at least partially fill the first volume; and securing a force dampening material at least partially around the interior encompassing member;

wherein said force dampening material is configured to at least partially dissipate forces originating from a blast event.

2. The method of claim 1, wherein the fill material comprises concrete, grout or epoxy.

3. The method of claim 1, wherein the interior encompassing member comprises a fiber reinforced polymer.

4. The method of claim 1, further comprising placing at least one layer of fiber reinforced polymer around the interior encompassing member prior to securing the force dampening material around the interior encompassing member.

5. The method of claim 4, wherein the at least one layer of fiber reinforced polymer comprises carbon fiber reinforced polymer (CFRP) or glass fiber reinforced polymer (GFRP).

6. The method of claim 1, further comprising positioning a second encompassing member around the force dampening material, said force dampening material located generally between the interior encompassing member and the second encompassing member.

7. The method of claim 1, further comprising placing at least one layer of metal around the force dampening material.

8. The method of claim 7, wherein the metal comprises steel.

9. The method of claim 1, wherein the force dampening material comprises polyurethane, silicone polymers, foam, a viscoelastic damper or another polymeric or elastomeric material.

10. The method of claim 1, wherein the force dampening material comprises at least one spring or other resilient member.

11. The method of claim 1, further comprising reinforcing an adjacent foundation or slab with at least one layer of fiber reinforced polymer to provide progressive collapse resistance.

12. The method of claim 1, further comprising placing at least one shape memory member along the inside or outside of the interior encompassing member.

13. The method of claim 12, wherein the shape memory member comprises a rod that extends, at least partially, along a length of the structural member.

14. The method of claim 1, further comprising performing surface preparation on at least a portion of an exterior surface of the structural member prior to positioning the interior encompassing member around said structural member.

15. The method of claim 14, wherein the surface preparation comprises cleaning, blasting, scouring or coating.

16. The method of claim 1, further comprising positioning a metal plate at an interface of the structural member and an adjacent foundation, said metal plate being configured to couple to the structural member, wherein said metal plate is secured to a surface of said foundation using at least one anchor, said surface of said foundation being generally perpendicular to said structural member; and wherein said metal plate being configured to further protect said structural member during a blast event so that said structural member remains structurally attached to said foundation.

17. The method of claim 1, wherein the structural member comprises a column.

18. A method of reinforcing a pre-positioned member, the method comprising:

positioning an interior encompassing member around the pre-positioned member, wherein a first void is defined between said interior encompassing member and said pre-positioned member;

depositing a first fill material within the first void to at least partially fill the first void; and securing at least one force dampening material around the interior encompassing member;

wherein said force dampening material is configured to at least partially dissipate forces originating from a blast event; and placing at least one layer of fiber reinforced polymer around the interior encompassing member prior to securing the force dampening material around the interior encompassing member.

19. The method of claim 18, wherein the fill material comprises concrete, grout or epoxy.

20. The method of claim 18, wherein the interior encompassing member comprises a fiber reinforced polymer.

21. The method of claim 20, wherein the at least one layer of fiber reinforced polymer comprises carbon fiber reinforced polymer (CFRP) or glass fiber reinforced polymer (GFRP).

22. The method of claim 18, wherein depositing the first fill material includes flowing the first fill material into the first void to at least partially fill the first void.

23. The method of claim 18, further comprising curing the first fill material after depositing the first fill material in the first void.

24. The method of claim 1, wherein depositing the first fill material includes flowing the first fill material into the first volume to at least partially fill the first volume.

25. The method of claim 1, further comprising curing the first fill material after depositing the first fill material in the first volume.

* * * * *